United States Patent [19]

Shirk

[11] Patent Number: 4,861,059

[45] Date of Patent: Aug. 29, 1989

[54] HOLDER APPARATUS ATTACHABLE ON A WHEELCHAIR FOR HOLDING A CATHETER BAG AND THE LIKE

[76] Inventor: Lynn V. Shirk, 2209 St. Joe Center Rd., Apt. 207-B, Fort Wayne, Ind. 46805

[21] Appl. No.: 185,088

[22] Filed: Apr. 22, 1988

[51] Int. Cl.[4] ..... A47C 7/62

[52] U.S. Cl. ..... 280/304.1; 5/503; 5/508; 224/275; 224/282; 224/901; 248/129; 248/231; 248/311.2; 297/188; 297/DIG. 4

[58] Field of Search ..... 280/304.1, 250.1; 297/188, DIG. 4; 248/129, 311.2, 231; 224/273, 275, 282, 901, 42.41; 5/503, 508

[56] References Cited

U.S. PATENT DOCUMENTS

| | | | |
|---|---|---|---|
| 3,612,460 | 10/1971 | Smith | 248/231 X |
| 3,709,556 | 1/1973 | Allard et al. | 297/188 |
| 3,896,809 | 7/1975 | Samuel et al. | 248/68.1 |
| 4,146,265 | 3/1979 | Ocel et al. | 297/188 |
| 4,213,648 | 7/1980 | Steichen | 297/188 |
| 4,339,061 | 7/1982 | Dunn | 224/901 X |
| 4,431,206 | 2/1984 | Pryor | 280/289 WC |
| 4,477,046 | 10/1984 | Repp | 248/95 |
| 4,577,903 | 3/1986 | Wells | 297/188 |

FOREIGN PATENT DOCUMENTS

| | | | |
|---|---|---|---|
| 2025192 | 12/1971 | Fed. Rep. of Germany | 224/275 |
| 491775 | 9/1938 | United Kingdom | 224/282 |
| 519847 | 4/1940 | United Kingdom | 224/282 |

*Primary Examiner*—Mitchell J. Hill

*Attorney, Agent, or Firm*—Albert L. Jeffers; Anthony Niewyk

[57] ABSTRACT

A holder apparatus, being attachable on a wheelchair frame for holding a catheter bag and the like, includes a pouch defining a rectangular-shaped compartment closed at its bottom and open at its top for permitting a catheter bag to be easily inserted therein or removed therefrom, and attachment components in the form of an elongated pivot rod mounted across the pouch adjacent to the closed bottom thereof and being adapted for mounting the pouch to a portion of a wheelchair frame so as to locate the pouch below and behind the wheelchair seat. The attachment components also include a pair of clamps connected to the opposite ends of the pivot rod and being adjustable for attaching them upon and releasing them from the wheelchair frame portion. The pivot rod also mounts the pouch for pivotal movement relative to the wheelchair frame portion so as to permit the pouch to be tilted away from the wheelchair seat to a service position in which the catheter bag can be easily inserted into or removed from the pouch or tilted toward the wheelchair seat to a storage position in which the pouch holds the catheter bag substantially out of sight and out of the way while a patient uses the wheelchair. The pivot rod defines a pivotal axis across the pouch being situated relative to the pouch such that when the pouch is in its stored position, its center of gravity is located between the pivotal axis and the wheelchair seat which tends to maintain the pouch in its stored position.

18 Claims, 2 Drawing Sheets

HOLDER APPARATUS ATTACHABLE ON A WHEELCHAIR FOR HOLDING A CATHETER BAG AND THE LIKE

BACKGROUND OF THE INVENTION

1. Field of the Invention

The present invention generally relates to medical devices and, more particularly, is concerned with a holder apparatus pivotally attachable on a wheelchair for removably holding a catheter bag and the like.

2. Description of the Prior Art

Many patients require the use of medical devices, such as a catheter drainage bag and tube, while confined to a wheelchair. Such devices must in some way be carried by the wheelchair. The decision of where and how to locate the devices on the wheelchair must be based on criteria which have the health and privacy of the patient foremost in mind.

First, care must be taken to ensure the devices are located on the chair where they cannot be easily struck inadvertently by either the person pushing the wheelchair, persons passing by the wheelchair, or the patient sitting on the wheelchair. Second, a location of the catheter bag lower than the patient must be selected to ensure proper operation of the catheter. Third, a location where the catheter bag is substantially hidden from view should be chosen so that the privacy of the patient will be preserved. Fourth, the location and manner of mounting should be selected so as to allow easy access to the catheter bag by medical personnel for changing it and otherwise carrying out medical procedures relative to it.

Several arrangements for supporting a catheter bag and tube as well as other medical devices are known in the prior patent art. Representative of such prior art arrangements are the ones disclosed in U.S. Pat. Nos. to Allard et al (3,709,556), Samuel et al (3,896,809), Ocel et al (4,146,265), Steichen (4,213,648), Pryor (4,431,206), Repp (4,477,046) and Wells (4,577,903). While many of these prior art arrangements might generally achieve their objectives under the range of operating conditions for which they were designed, none appears to provide an optimum solution to the problem of providing the proper location and manner of support of the devices.

Consequently, a need exists for an approach particularly adapted to locate and support a catheter bag and tube so as to substantially meet the aforementioned criteria.

SUMMARY OF THE INVENTION

The present invention provides a wheelchair-mounted holder apparatus designed to satisfy the aforementioned needs. The holder apparatus of the present invention is primarily intended to be used to receive and hold a catheter bag for a patient confined to a wheelchair. Specifically, the holder apparatus includes a pouch being pivotally attached below and behind the seat of the wheelchair to the lower frame members thereof. The pivotal attachment permits a health care worker to tilt the pouch backward away from the back of the wheelchair to a service position in order to easily insert or remove the catheter bag and then tilt it forward toward the wheelchair back to a storage position in which the pouch holds the bag out of sight and out of the way while the patient uses the wheelchair. The pivot location of the pouch is situated such that when it is in its stored position, its center of gravity tends to keep it there.

Accordingly, the present invention is directed to a holder apparatus attachable on a wheelchair for holding a catheter bag and the like. The holder apparatus includes: (a) a pouch generally rectangular in shape defining a compartment closed at its bottom and open at its top permitting a catheter bag to be easily inserted therein or removed therefrom; and (b) attachment means mounted to the pouch adjacent the closed bottom thereof and being adapted for mounting the pouch to a portion of a wheelchair frame so as to locate the pouch below and behind a seat of the wheelchair. The attachment means is also adapted for mounting the pouch for pivotal movement relative to the wheelchair frame portion so as to permit the pouch to be tilted away from the wheelchair seat to a service position in which the catheter bag can be easily inserted into or removed from the pouch or tilted toward the wheelchair seat to a storage position in which the pouch holds the catheter bag substantially out of sight and out of the way while a patient uses the wheelchair.

The holder apparatus further includes at least one and preferably a pair of elongated flexible members adapted to extend between and interconnect the pouch at its opposite sides and adjacent its open top with the wheelchair frame so as to limit the amount by which the pouch can pivot away from the wheelchair seat from the storage position to the service position of the pouch. Further, the pouch, on a side thereof being adjacent the wheelchair seat when the pouch is in its storage position, has a cutout portion for accommodating extension therethrough of a catheter tube to the catheter bag held within the pouch.

The attachment means of the holder apparatus defines a pivotal axis across the pouch being situated relative to the pouch such that when the pouch is in its stored position, its center of gravity is located between the pivotal axis and the wheelchair seat which tends to maintain the pouch in its stored position. Specifically, the attachment means includes an elongated pivot rod extending across the pouch adjacent the closed bottom thereof to define the pivotal axis. The pivot rod has opposite ends which extend beyond opposite sides of the pouch. The attachment means further includes a pair of clamps. Each clamp is connected to one of the respective opposite ends of the pivot rod and is adjustable for attaching the clamp upon and releasing the clamp from the wheelchair frame portion. Each clamp has a circular clamping portion which receives a tubular frame portion member therethrough. The opposite ends of the pivot rod have respective sleeves mounted thereon for aligning the pouch in a desired position along the pivot rod.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
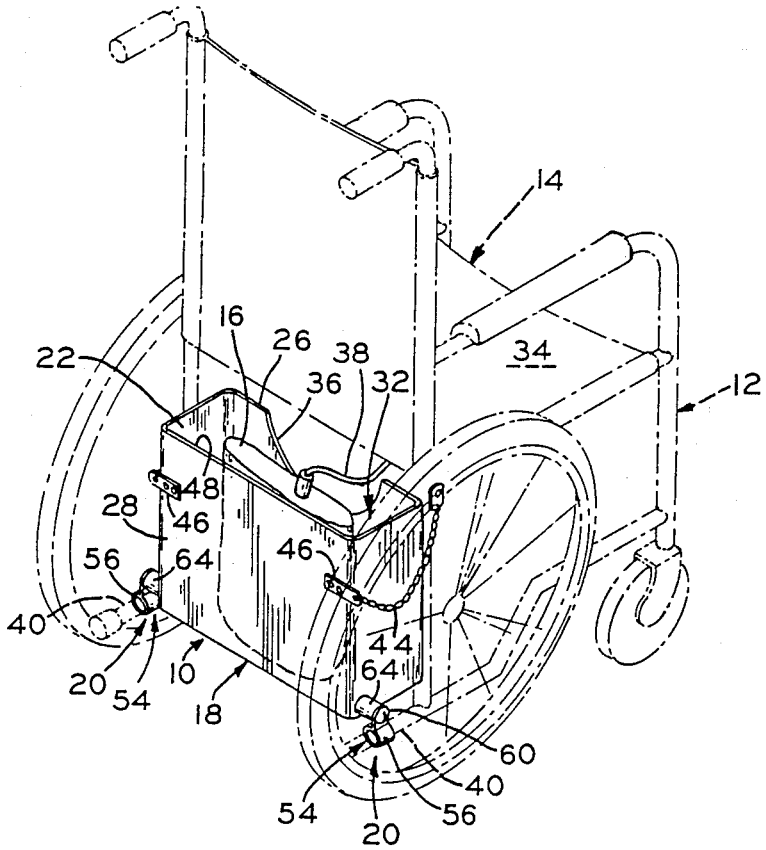
FIG. 1 is a perspective view of a wheelchair shown in phantom with a holder apparatus constructed in accordance with the principles of the present invention having a pivotally-mounted pouch shown disposed in a storage position.
Figure 2:
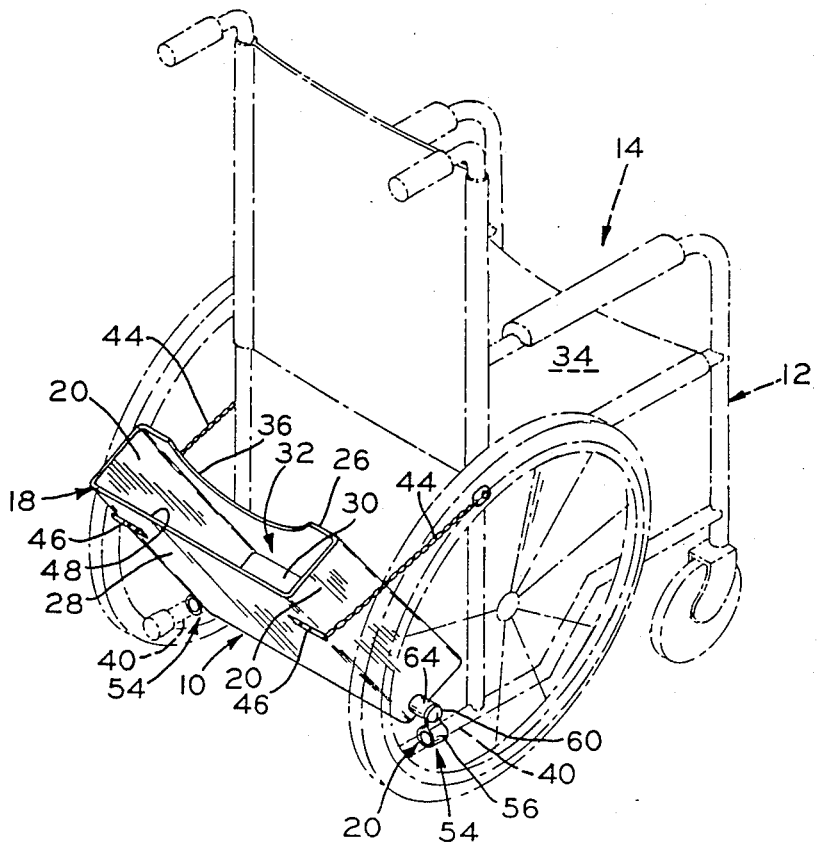
FIG. 2 is a perspective view similar to that of FIG. 1, but showing the pouch of the holder apparatus disposed in a service position.

Referring now to the drawings, and particularly to FIGS. 1 and 2, a catheter bag holder apparatus, generally designated by the numeral 10 and constituting the preferred embodiment of the present invention, is shown attached to the frame 12 of a conventional wheelchair 14, being illustrated in phantom, and holding a catheter bag 16. The holder apparatus 10 basically includes a pouch 18 and attachment means 20.

Figure 3:
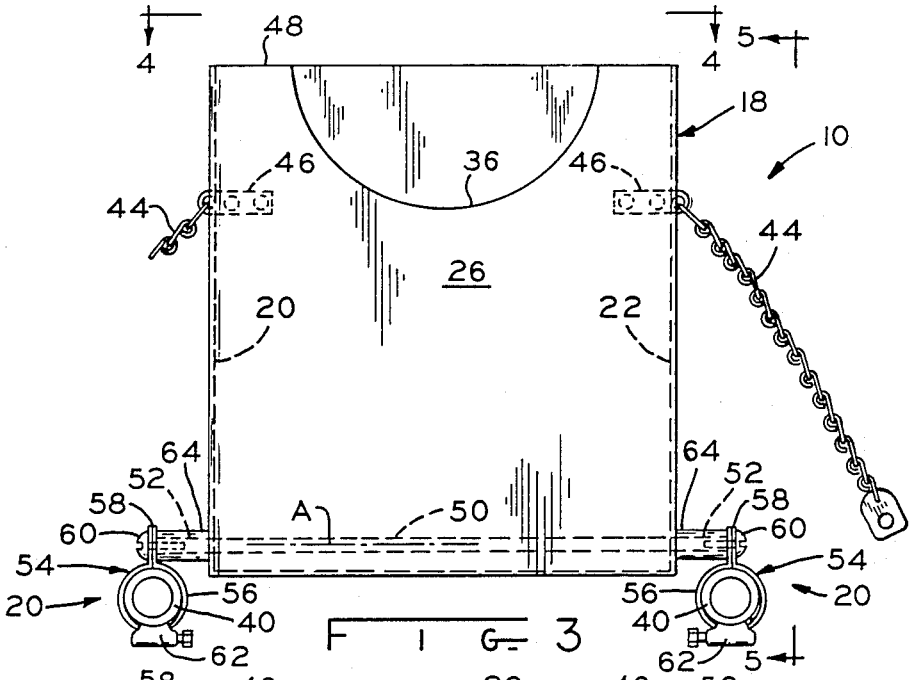
FIG. 3 is an enlarged front elevational view of the holder apparatus of FIG. 1.
Figure 4:
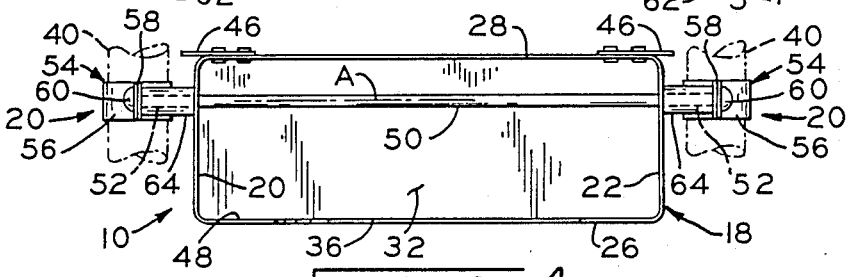
FIG. 4 is a top plan view of the holder apparatus as seen along line 4—4 of FIG. 3.
Figure 5:
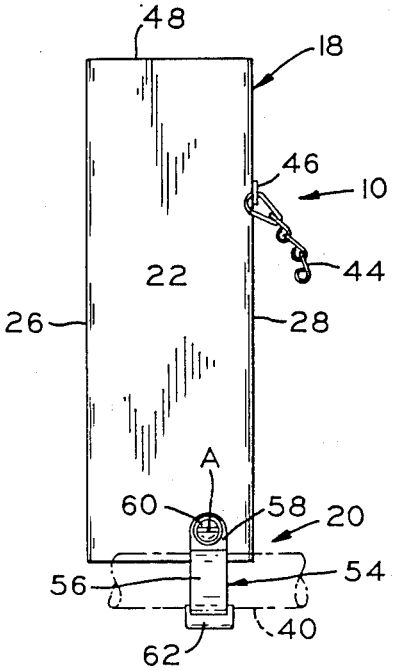
FIG. 5 is a side elevational view of the holder apparatus as seen along line 5—5 of FIG. 3.

More particularly, referring also to FIGS. 3–5, the pouch 18 of the holder apparatus 10 is generally rectangular in shape having a pair of parallel side walls 22, 24, a pair of parallel front and rear walls 26, 28 and a bottom wall 30. All of the walls 22–30 are interconnected together to define a compartment 32 being closed at its bottom and open at its top for permitting the catheter bag 16 to be easily inserted therein or removed therefrom. The catheter bag 16 can either rest on the bottom wall 30 of the pouch 18, or a clip (not shown) can be located on the rear wall 28 of the pouch 18 from which to hang the bag 16 within the compartment 32.

Preferably, the pouch 18 is formed from a suitable material which will render it relatively rigid in structure and is capable of frequent cleaning. By way of example, the pouch 18 can be approximately $3\times15\times18$ inches in size. Further, the pouch 18 on its front wall 26 adjacent to the seat 34 of the wheelchair 14 has a semi-circular cutout portion 36 for accommodating extension therethrough of a catheter tube 38 to the catheter bag 16 being held within the pouch 18.

The attachment means 20 is mounted to the pouch 18 adjacent to the closed bottom wall 30 thereof and adapted for mounting the pouch 18 across and between a pair of rearwardly-projecting tubular members 40 the wheelchair frame 12 so as to locate the pouch 18 below and behind the wheelchair seat 34. The attachment means 20 also mounts the pouch 18 for pivotal movement relative to the tubular members 40 of the wheelchair frame 12. Such pivotal mounting of the pouch 18 permits a health care worker to tilt the pouch 18 away from the wheelchair seat 34 to a service position, such as illustrated in FIG. 2, in which the catheter bag 16 can be easily inserted into or removed from the pouch 18 and then back toward the wheelchair seat 34 to a storage position, such as illustrated in FIG. 1, in which the pouch 18 holds the catheter bag 16 substantially out of sight and out of the way while a patient uses the wheelchair 14. As depicted in the FIGS. 1 and 2, in the storage position the pouch 18 assumes a more or less vertical orientation, whereas in the service position it preferably assumes an orientation in which it is angularly displaced about forty-five degrees from the vertical. Other angular displacements are possible as desired.

The holder apparatus 10 further includes a pair of elongated flexible members 44 in the form of chains or cables connected at one end to the pouch 18 at its opposite sides by brackets 46 attached to its rear wall 28 adjacent its open top 48. At the opposite end the flexible members 44 are releasably attachable to the wheelchair frame 12 adjacent to opposite rear sides of the seat 34. The lengths of the flexible members 44 thereby limit the amount by which the pouch 18 can pivot away from the wheelchair seat 34 in tilting from the storage position (FIG. 1) to the service position (FIG. 2) of the pouch 18.

The attachment means 20 of the holder apparatus 10 defines a pivotal axis A extending across the bottom of the pouch 18 through the side walls 22, 24 and just above the bottom wall 30 thereof. As can be seen in FIGS. 4 and 5, the pivotal axis A is situated closer to the rear wall 28 than to the front wall 26 of the pouch 18 such that when the pouch 18 is in its stored position (FIGS. 1 and 3–5), its center of gravity will be located between the pivotal axis A and the wheelchair seat 34 which tends to maintain the pouch 18 in its stored position.

Figure 6:
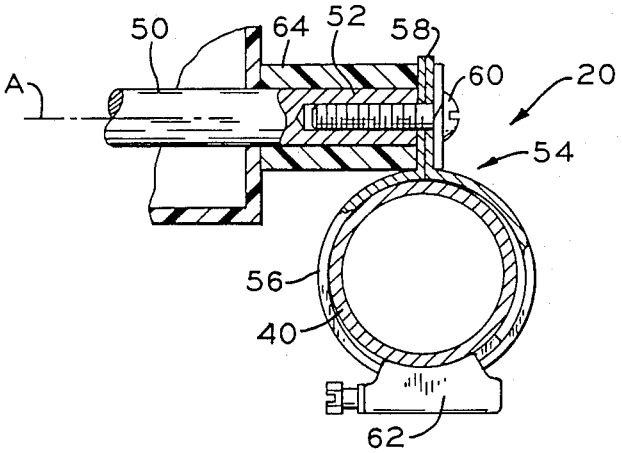
FIG. 6 is an enlarged fragmentary sectional view of one end of the components of the holder apparatus for pivotally attaching the pouch to the wheelchair frame.

As best seen in FIGS. 3, 4 and 6, the attachment means 20 includes an elongated pivot rod 50 extending across the pouch 18 adjacent the closed bottom thereof to define the pivotal axis A. The pivot rod 50 has opposite end portions 52 which extend beyond opposite side walls 22, 24 of the pouch 18. The attachment means 20 further includes a pair of clamps 54. Each clamp 54 has a circular clamping portion 56 and a planar anchoring portion 58. The circular clamping portion 56 receives one of the tubular frame members 40 therethrough. A threaded fastener 60 connects the clamp anchoring portion 58 to one of the pivot rod end portions 52, as seen in FIG. 6.

Also, each clamp 54 has a threadable adjustment device 62 which receives the ends of the clamping portion 56. The adjustment device 62 is operable for reducing or increasing the inside diametric size of the circular clamping portion 56 for adjustably attaching the clamp 54 upon or releasing the clamp 54 from the wheelchair frame members 40. Once the adjustment devices 62 have been adjusted to loosen the grip of the clamping portions 56 on the frame members 40, the holder apparatus 10 can be readily slipped rearwardly off the members 40. Further, the opposite end portions 52 of the pivot rod 50 have respective sleeves 64 mounted thereon for aligning the pouch 18 in a desired position along the pivot rod 50.

It will be observed that the makeup of the attachment means 20 allows the pouch 18 to be easily removed from the wheelchair 14 for cleaning thereof or for folding of the wheelchair.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely preferred or exemplary embodiments thereof.

What is claimed is:

1. A holder apparatus attachable on a wheelchair, the wheelchair comprising a seat and a frame, for holding a catheter bag, said apparatus comprising;

(a) a pouch substantially shaped with a rectangular vertical cross-section defining a compartment including structurally rigid interconnected walls, closed at its bottom and open at its top for permitting a catheter bag to be easily inserted therein or removed therefrom; and (b) attachment means mounted to said pouch adjacent to said closed bottom thereof for pivotally mounting said pouch to said wheelchair frame so as to locate said pouch below and behind a seat of the wheelchair, said attachment means including adjustment means for releasably mounting said pouch whereby said pouch is mounted for pivotal movement relative to the wheelchair frame so as to permit said pouch to be titled away from the wheelchair seat to a service position in which the catheter bag can be easily inserted into or removed from said pouch and titled toward the wheelchair seat to a storage position in which said pouch holds the catheter bag substantially out of sight and out of the way while a patient uses the wheelchair.

2. The holder apparatus as recited in claim 1, further comprising:

at least one elongated flexible member secured to said pouch exterior adapted to extend between and interconnect said pouch adjacent its open top with the wheelchair frame so as to limit the amount by which said pouch can pivot away from the wheelchair seat from said storage position to said service position of said pouch.

3. The holder apparatus as recited in claim 2, wherein a pair of said flexible members are provided, each extending between one side of said pouch and the wheelchair frame.

4. The holder apparatus as recited in claim 1, wherein said pouch, on a side thereof being adjacent the wheelchair seat when said pouch is in its storage position, has a cutout portion for accommodating extension therethrough of a catheter tube to the catheter bag held within said pouch.

5. The holder apparatus as recited in claim 1, wherein said attachment means defines a pivotal axis across said pouch being situated relative to said pouch such that when said pouch is in its stored position, its center of gravity relative to said pivotal axis tends to maintain said pouch in its stored position.

6. The holder apparatus as recited in claim 1, wherein said attachment means includes:

an elongated pivot rod extending across said pouch adjacent to said closed bottom thereof and having opposite ends which extend beyond opposite walls of said pouch.

7. The holder apparatus as recited in claim 6, wherein said adjustment means comprises a plurality of clamps connected to said respective opposite ends of said pivot rod and which are adjustable for attaching said clamps upon and releasing said clamps from said wheelchair frame.

8. A holder apparatus attachable on a wheelchair for holding a catheter bag, said apparatus comprising:

(a) a pouch defining a compartment closed at its bottom and open at its top for permitting a catheter bag to be easily inserted therein or removed therefrom; and (b) attachment means mounted to said pouch adjacent to said closed bottom thereof and being adapted for mounting said pouch to a portion of a wheelchair frame so as to locate said pouch below and behind a seat of the wheelchair, said attachment means having an elongated pivot rod extending across said pouch adjacent to said closed bottom thereof and having opposite ends which extend beyond said pouch wherein said opposite ends of said pivot rod have respective sleeves mounted thereon for aligning said pouch in a desired position along said rod, said attachment means also being adapted for mounting said pouch for pivotal movement relative to the wheelchair frame portion so as to permit said pouch to be titled away from the wheelchair seat to a service position in which the catheter bag can be easily inserted into or removed from said pouch and tilted toward the wheelchair seat to a storage position in which said pouch holds the catheter bag substantially out of sight and out of the way while a patient uses the wheelchair.

9. The holder apparatus as recited in claim 8, wherein said pouch is generally rectangular in shape.

10. In combination with a wheelchair having a frame and a seat mounted on said frame, said frame having a portion located below and behind said wheelchair seat, a holder apparatus attached on said wheelchair frame portion for holding a catheter bag, said holder apparatus comprising:

(a) a pouch defining a compartment closed at its bottom and open at its top for permitting a catheter bag to be easily inserted therein or removed therefrom; and (b) attachment means mounted to said pouch adjacent to said closed bottom thereof and, in turn, being mounted to said wheelchair frame portion thereby locating said pouch below and behind said wheelchair seat, said attachment means also mounting said pouch for pivotal movement relative to said wheelchair frame portion thereby permitting said pouch to be tilted backward away from said wheelchair seat to a service position in which the catheter bag can be easily inserted into or removed from said pouch and tilted forward toward said wheelchair seat to a storage position in which said pouch holds the catheter bag substantially out of sight and out of the way while a patient uses the wheelchair.

11. The holder apparatus as recited in claim 10, further comprising:

at least one elongated flexible member extending between and interconnecting said pouch adjacent to its open top with said wheelchair frame so as to limit the amount by which said pouch can pivot away from said wheelchair seat from said storage position to said service position of said pouch.

12. The holder apparatus as recited in claim 11, wherein a pair of said flexible members are provided, each extending between one side of said pouch and the wheelchair frame.

13. The holder apparatus as recited in claim 10, wherein said pouch, on a side thereof being adjacent to the wheelchair seat when said pouch is in its storage position, has a cutout portion for accommodating extension therethrough of a catheter tube to the catheter bag held within said pouch.

14. The holder apparatus as recited in claim 10, wherein said pouch is generally rectangular in shape.

15. The holder apparatus as recited in claim 10, wherein said attachment means defines a pivotal axis across said pouch being situated relative to said pouch such that when said pouch is in its stored position, its center of gravity relative to said pivotal axis is between said pivotal axis and said wheelchair seat which tends to maintain said pouch in its stored position.

16. The holder apparatus as recited in claim 15, wherein said attachment means includes:

an elongated pivot rod extending across said pouch adjacent said closed bottom thereof and defining said pivot axis, said pivot rod having opposite ends which extend beyond opposite sides of said pouch.

17. The holder apparatus as recited in claim 16, wherein said attachment means further includes:

clamps connected to said respective opposite ends of said pivot rod and being adjustable for attaching said clamps upon and releasing said clamps from the wheelchair frame portion.

18. The holder apparatus as recited in claim 16, wherein said opposite ends of said pivot rod have respective sleeves mounted thereon for aligning said pouch in a desired position along said rod.

* * * * *